US012509282B2

(12) United States Patent
McAtarian et al.

(10) Patent No.: US 12,509,282 B2
(45) Date of Patent: Dec. 30, 2025

(54) EQUIPMENT TRANSPORT BAG

(71) Applicant: Andax Industries, L.L.C., Saint Marys, KS (US)

(72) Inventors: Patrick F. McAtarian, Saint Marys, KS (US); Mark McAtarian, Saint Marys, KS (US)

(73) Assignee: Andax Industries, L.L.C., Saint Marys, KS (US)

( * ) Notice: Subject to any disclaimer, the term of this patent is extended or adjusted under 35 U.S.C. 154(b) by 0 days.

(21) Appl. No.: 18/528,269

(22) Filed: Dec. 4, 2023

(65) Prior Publication Data

US 2024/0109690 A1 Apr. 4, 2024

Related U.S. Application Data

(63) Continuation-in-part of application No. 18/342,558, filed on Jun. 27, 2023, which is a continuation of application No. 18/054,605, filed on Nov. 11, 2022, now Pat. No. 11,702,249, which is a continuation of application No. 16/026,942, filed on Jul. 3, 2018, now abandoned.

(51) Int. Cl.

| | |
|---|---|
| ***B65D 33/06*** | (2006.01) |
| ***B65D 33/02*** | (2006.01) |
| ***B65D 85/30*** | (2006.01) |

(52) U.S. Cl.

CPC ..... *B65D 33/06* (2013.01); *B65D 33/02* (2013.01); *B65D 85/30* (2013.01)

(58) Field of Classification Search

CPC ..... B65D 33/06; B65D 33/02; B65D 85/30

USPC ..... 206/701, 720; 383/6, 15, 16, 17, 18, 24, 383/28; 294/68.1, 68.3; 220/475

See application file for complete search history.

(56) References Cited

U.S. PATENT DOCUMENTS

| | | | | | |
|---|---|---|---|---|---|
| 1,904,729 | A * | 4/1933 | Hancock | F25C 5/20 | 2/248 |
| 4,062,392 | A * | 12/1977 | Ishii | A45C 3/04 | 383/18 |
| 4,194,652 | A * | 3/1980 | Williamson | B65D 88/1612 | 112/475.08 |
| 4,300,608 | A * | 11/1981 | Cuthbertson | B65D 88/1687 | 383/7 |
| 4,730,942 | A * | 3/1988 | Fulcher | B65D 88/1681 | 383/7 |
| 5,344,109 | A * | 9/1994 | Hokoana, Jr. | B65F 1/1415 | 383/33 |
| 5,938,338 | A * | 8/1999 | McDonough | B65D 88/1618 | 383/117 |
| 6,155,772 | A * | 12/2000 | Beale | B65D 90/205 | 383/117 |
| 7,437,784 | B1 * | 10/2008 | Turnipseed | B65D 33/24 | 383/18 |

(Continued)

*Primary Examiner* — Jacob K Ackun

(74) *Attorney, Agent, or Firm* — Hovey Williams LLP

(57) ABSTRACT

Equipment transport bag assemblies (20, 92, 98, 145, 152, 182) each including an upright, open-top, equipment-receiving bag (22, 110, 158) with associated equipment-handling assemblies (24, 92, 102, 164, 184). The assemblies (24, 92, 102, 164, 184) have load-bearing strap units (34, 114, 166, 186) operably associated with the transport bags (22, 110, 158) so that the strap units (34, 114, 166, 186) bear the primary loads during lifting and handling of the bag assemblies (20, 92, 98, 145, 152, 182).

21 Claims, 11 Drawing Sheets

(56) References Cited

U.S. PATENT DOCUMENTS

| | | | | |
|---|---|---|---|---|
| 8,011,500 | B2 * | 9/2011 | Lee | A45C 3/04<br>206/554 |
| 8,777,001 | B1 * | 7/2014 | Bennett | B65D 85/00<br>206/204 |
| 2007/0086681 | A1 * | 4/2007 | Richardson | B65D 88/62<br>383/33 |
| 2014/0029872 | A1 * | 1/2014 | Ness | B65B 69/0008<br>383/12 |
| 2014/0177980 | A1 * | 6/2014 | Diao | B65D 88/1693<br>493/243 |

* cited by examiner

EQUIPMENT TRANSPORT BAG

CROSS REFERENCE TO RELATED APPLICATION

The present application is a continuation-in-part of U.S. patent application Ser. No. 18/342,558, filed Jun. 27, 2023, which is a continuation of U.S. patent application Ser. No. 18/054,605, filed Nov. 11, 2022, which is a continuation of U.S. patent application Ser. No. 16/026,942, filed Jul. 3, 2018, the entire disclosure of each which is hereby incorporated by reference herein.

BACKGROUND OF THE INVENTION

Field of the Invention

The present invention is concerned with equipment containment bag assemblies designed to provide environmentally safe shipping and storage conditions for leaking or otherwise non-performing equipment, such as pole-mounted distribution transformers, switchgear, breakers, and reclosers, equipped with lifting appendages (e.g., lifting lugs, eyes, or hooks). More particularly, the invention is concerned with such bag assemblies having an open-top equipment-receiving bag with an equipment-handling assembly associated with the bag and including at least one load-bearing strap unit designed to engage the at least one lifting appendage, and interconnected bag-supporting sections. In this way, the load-bearing strap units bear the primary loads associated with lifting and handling of equipment within the bag.

Description of the Prior Art

Conventional electrical transformers used in power distribution systems include a sealed, oil-filled tank with internal electrical components, such as transformer coils. These transformers also have external hardware, such as mounting equipment, connection busses, and lifting lugs. These transformers are subject to leaking over time, resulting from damage to the transformer tank or from extended use. Such leakages can be environmentally damaging, inasmuch as the oil formulations within the transformers can often include hazardous chemicals (e.g., PCBs). In any event, it is necessary to safely transport failed transformers for disposal or repair, in accordance with governmental regulations. In like manner, other types of equipment, and especially electrical utility equipment, require safe and effective containment and shipping enclosures.

A number of different transformer containment devices have been provided in the past. For example, Andax Industries LLC has commercialized Xtra HD Pole-Mount Transformer Sac™ containment bags, which have large, puncture-proof transformer bags with opposed perforated sections which can be opened to allow access to transformer lifting lugs. However, these bags do not provide any closures for these openings, and accordingly moisture or contaminants can enter the bags.

U.S. Pat. No. 8,777,001 describes another type of transformer containment bag which includes a bag with an internal liner and external lifting hoops. These kinds of bags are deficient, and indeed do not meet relevant regulatory standards, because the lifting lugs of the transformers cannot be accessed, thus requiring that the transformers be elevated and moved using only the bag components, which places considerable stress on the overall assemblies.

SUMMARY OF THE INVENTION

The present invention overcomes the problems outlined above and provides equipment transport bag assemblies, which allow lifting and handling of equipment having one or more lifting appendages without imposing undue loads upon the equipment bags. To this end, the bag assemblies of the invention comprise an upright bag (which may be of any desired shape or size, such as circular or quadrate) including a bottom wall and upwardly extending sidewall structure, the bag presenting an open upper end and configured to receive equipment therein; an equipment-handling assembly is operably associated with the bag and equipment and includes at least one load-bearing strap unit for operably engaging the at least one lifting appendage, with associated structure engaging and supporting the bag so that the equipment is retained within the bag during handling thereof.

In certain embodiments where the equipment includes at least a pair of spaced lifting lugs, the equipment-handling assembly includes a pair of load-bearing strap units each having a first strap section with an arcuate portion configured to engage a corresponding lifting lug, and a second strap section with an arcuate lifting portion, the first and second strap sections operably connected together. Again, the equipment-handling assembly is operably coupled with the bag so that the equipment is retained within the bag during handling thereof. As used herein, "lifting lugs" or "lugs" refer to any type of integrated lifting point(s) associated with the equipment to allow safe lifting and handling thereof. The term "operably connected together" with respect to the strap sections and arcuate lifting sections refers to the fact that these sections may be configured using individual straps which are then interconnected, or from a single strap.

To this end, each of the first lug-engaging strap sections may be formed from a first strap of material having opposed ends, the opposed ends secured to the sidewall structure by stitching or any other suitable technique. Likewise, the second strap sections are formed from a second strap of material having opposed ends, the opposed ends of the second straps secured to the sidewall structure and to the first straps. The load-bearing strap sections may be formed as reverse loops or as bight sections.

In other embodiments where the equipment lifting appendage(s) comprise one or more lifting eyes, typically mounted at the top central region of the equipment. In such cases, the equipment-handling assembly is operably connected with the equipment and the bag and includes at least one load-bearing strap unit operably coupled with the lifting appendage; other structure may be used to secure the bag, such as a separate strap passing through the lifting eye.

Advantageously, in all of the embodiments, the equipment-handling assembly is designed so that the strap units bear a substantial portion of the lifting load, normally at least about 85% of the load of the equipment, and usually essentially 100% thereof. In this way, the bag is not unduly stressed during handling of the equipment, but rather primarily serves as a containment vessel, and bears only the load of its weight and that of any collected fluid therein.

BRIEF DESCRIPTION OF THE DRAWINGS

While the drawings do not necessarily provide exact dimensions or tolerances for the illustrated components or structures, FIGS. 1-16 are to scale with respect to the relationships between the components of the structures illustrated therein.

DETAILED DESCRIPTION OF THE PREFERRED EMBODIMENTS

Embodiments of FIGS. 1-11

These embodiments are particularly designed for use with equipment such as transformers, which are universally provided with a pair of opposed, side-mounted lifting lugs.

Figure 2:
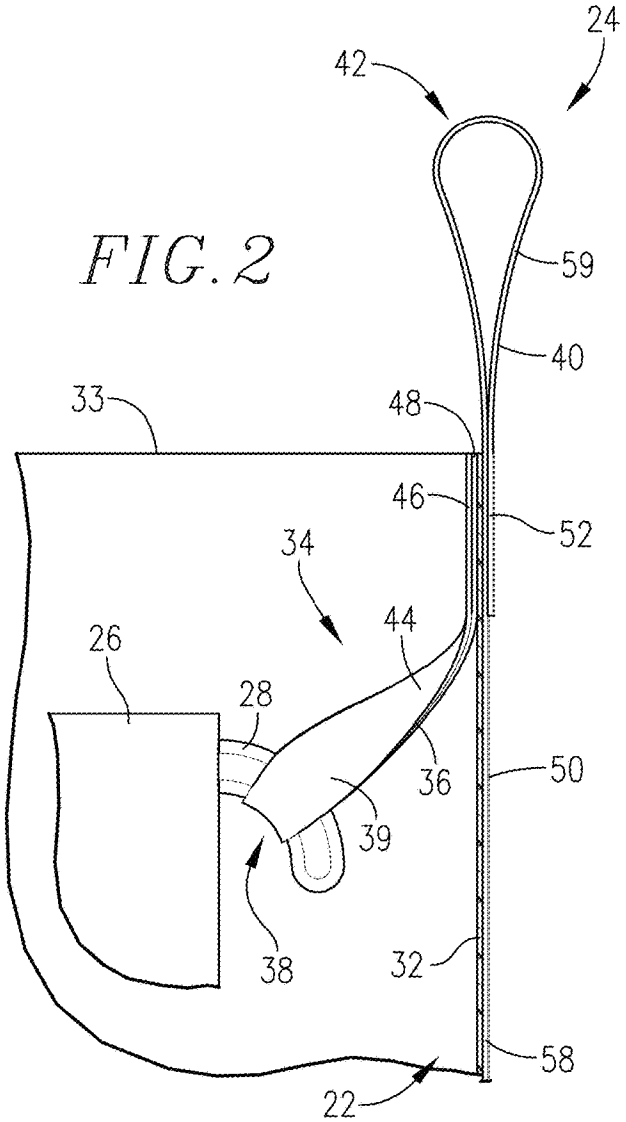
FIG. 2 is a fragmentary vertical sectional view illustrating one of the load-bearing strap units of the transport bag of FIG. 1.
Figure 1:
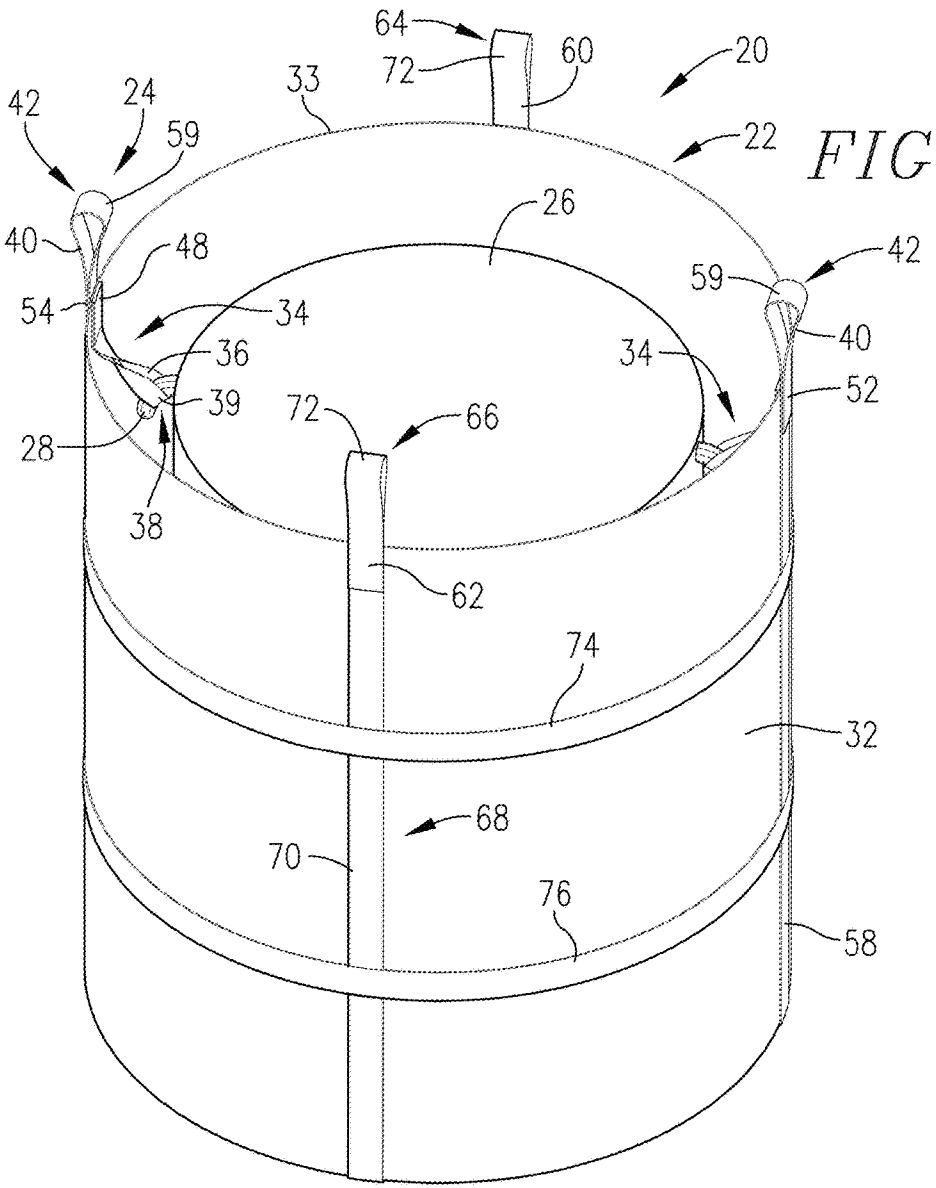
FIG. 1 is a perspective view of one embodiment of an equipment transport bag in accordance with the invention, shown with an electrical transformer within the bag, ready for lifting.
Figure 3:
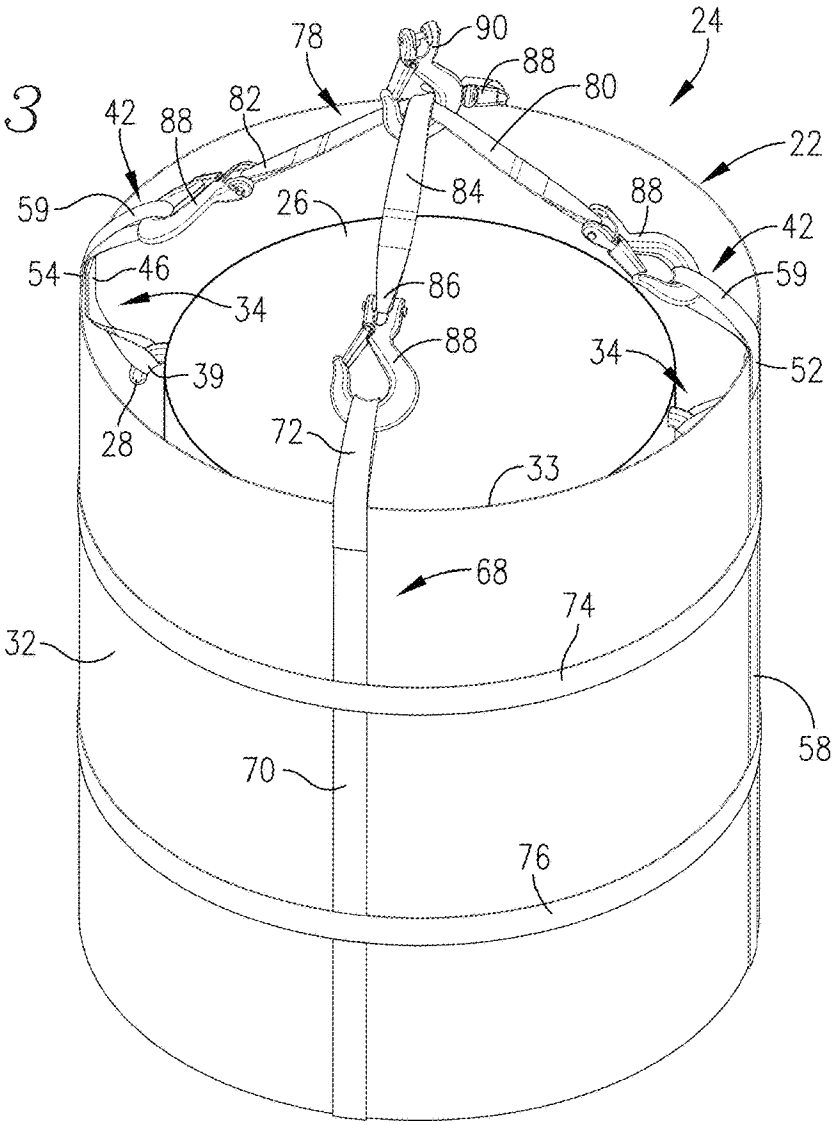
FIG. 3 is a perspective view similar to that of FIG. 1, but illustrating a lift assembly operably coupled with the equipment transport bag.
Figure 4:
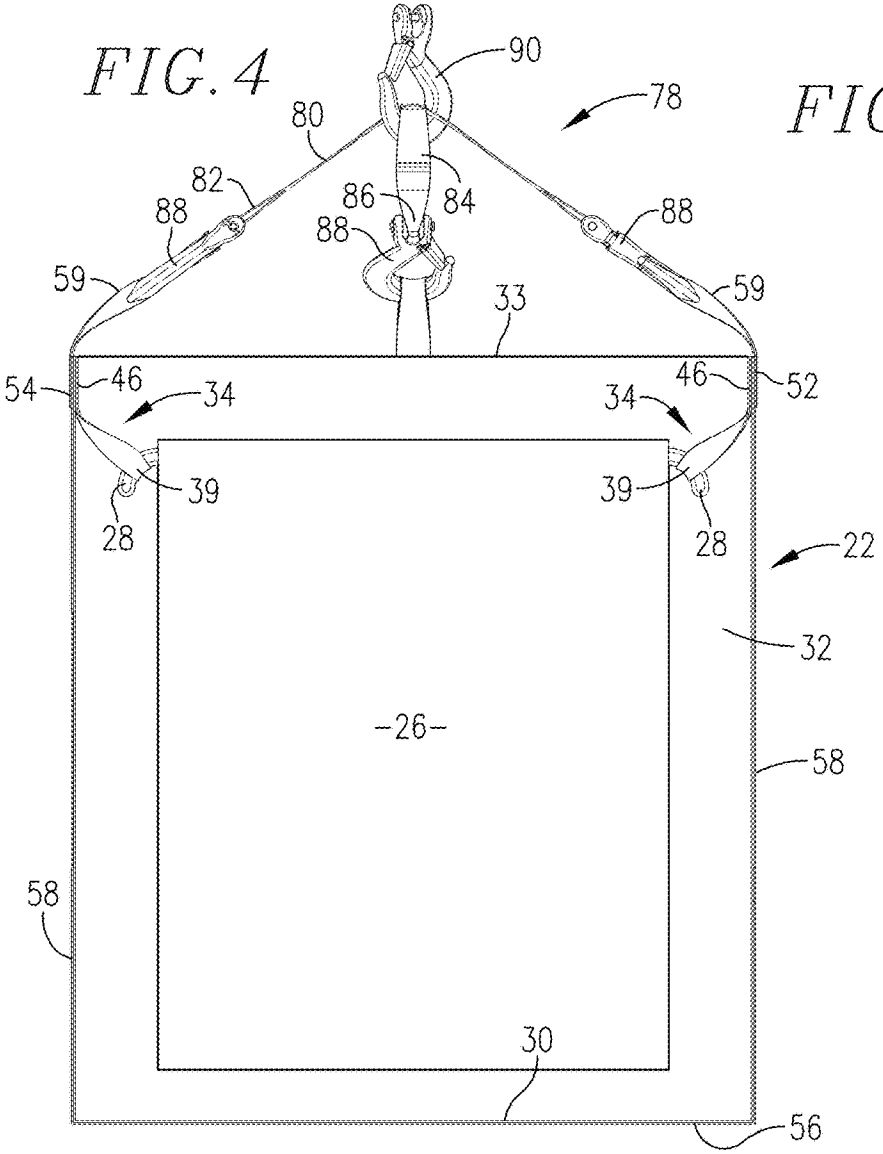
FIG. 4 is a vertical sectional view of the FIG. 1 embodiment, through the bag adjacent the central load-bearing straps, shown with the transformer supported by the load-bearing strap units.

Turning now to FIGS. 1-4, an equipment transport bag assembly 20 is depicted, which broadly includes an upright, open-top, generally circular in plan bag 22, together with an equipment-handling assembly 24. As illustrated, an electrical transformer 26 is received within bag 22, and has a pair of opposed, outwardly-extending lifting lugs 28 (FIGS. 2 and 4).

The bag 22 includes a bottom wall 30 and upwardly extending sidewall structure 32 terminating in an upper margin 33. The bag 22 may be fabricated from any suitable material, but is preferably formed of heavy-duty synthetic resin material, and is substantially leak-proof. As explained below, the function of bag 22 is primarily to contain any spillage of liquid from the transformer 26, and does not function as the primary load-bearing component during the lifting and handling of the transformer 26.

The assembly 24 includes a pair of opposed, load-bearing strap units 34, which, in this embodiment, are secured to the sidewall structure 32. Each such load-bearing strap unit 34 has a first section 36 with an arcuate portion 38 designed to engage a corresponding lifting lug 28, and a second strap section 40 with an arcuate lifting portion 42.

Each first strap section 36 is formed from an elongated first strap 44 having first and second ends 46 and 48. As illustrated, the ends 46, 48 terminate adjacent the upper margin 33 of sidewall structure 32, with the portion 38 being a loop 39 intermediate these ends. Each second strap section 40 is formed using a second, generally U-shaped strap 50 having opposed ends 52 and 54. The strap 50 presents a central bight 56 and upwardly extending, opposed legs 58. As shown, the bight 50 extends across bottom wall 30, whereas the legs 58 extend upwardly along the sidewall structure 32 to the upper margin 33; from this point, the legs 58 extend further upwardly and then downwardly to form each lifting portion 42 in the form of a loop 59. The bight 56 and legs 58 are secured to the bottom wall 30 and sidewall structure 32, respectively, by stitching or any other appropriate means.

The first and second strap sections 36 and 40 are secured to each other, and to sidewall structure 32 adjacent the upper margin 33. As illustrated in FIG. 2, the upper end of sidewall structure 32 is sandwiched between the ends 46, 48 of the first sections 36, and to the legs 58 and the terminal portions of the lifting portions 42. Such interconnections are preferably accomplished by means of stitching, but could be achieved by other means, such as by heat welding or suitable adhesive.

The overall equipment-handling assembly 24 also includes a pair of opposed, non-load-bearing, bag-orienting strap sections 60 and 62, each having a corresponding arcuate connection portion 64, 66. In this case, the strap sections 60, 62 are formed using a third U-shaped strap 68 presenting a central bight (not shown) and upstanding legs 70. The bight and legs 70 are secured to the bottom 30 of bag 22 and to the sidewall structure 32 thereof, respectively. The upper ends of each of the legs 70 extend above the margin 33 and are reversed to form loops 72. Again, the end portion of each loop 72 is secured to sidewall structure 32 by stitching or other appropriate means.

In order to provide further reinforcement for the bag 22, a pair of circumferentially extending upper and lower straps 74, 76 extend around sidewall structure 32 and the legs 58, and are secured thereto.

In order to effectively lift and transport the transformer 26 within the bag 22, an exemplary lift assembly 78 is employed (FIGS. 3-4). The assembly 78 includes a fourth strap 80 having endmost loops 82, as well as an identical fifth strap 84 with endmost loops 86. A clevis slip hook 88 is secured to each of the loops 82 and 86. As shown, the slip hooks 88 of strap 80 are secured to the loops 59, whereas the slip hooks 88 of strap 84 are secured to the loops 72. A single hook 90 engages the straps 80 and 84 at the central regions thereof, and is connected to a further lifting arrangement (not shown) to allow lifting and handling of bag 22 and the transformer 26 therein.

During such lifting and manipulation of bag 22, it will be appreciated that, owing to the construction of the strap units 34, these units and the associated lift assembly 78 bear a substantial part of the lifting load, and that the third strap 68, and the bag 22 itself, bear only a minor portion or none of the lifting load. In effect, the strap 68 and the associated loops 72 function primarily as a means of controlling the bag 22 during lifting and handling operations. For example, as set forth in FIG. 4, it will be observed that during lifting the transformer 26 is simply contained within bag 22 and does not engage the bag 22 at all. Thus, the strap units bear essentially all of the load of the equipment, while the bag 22 bears its own weight and any fluid collected therein.

Figure 6:
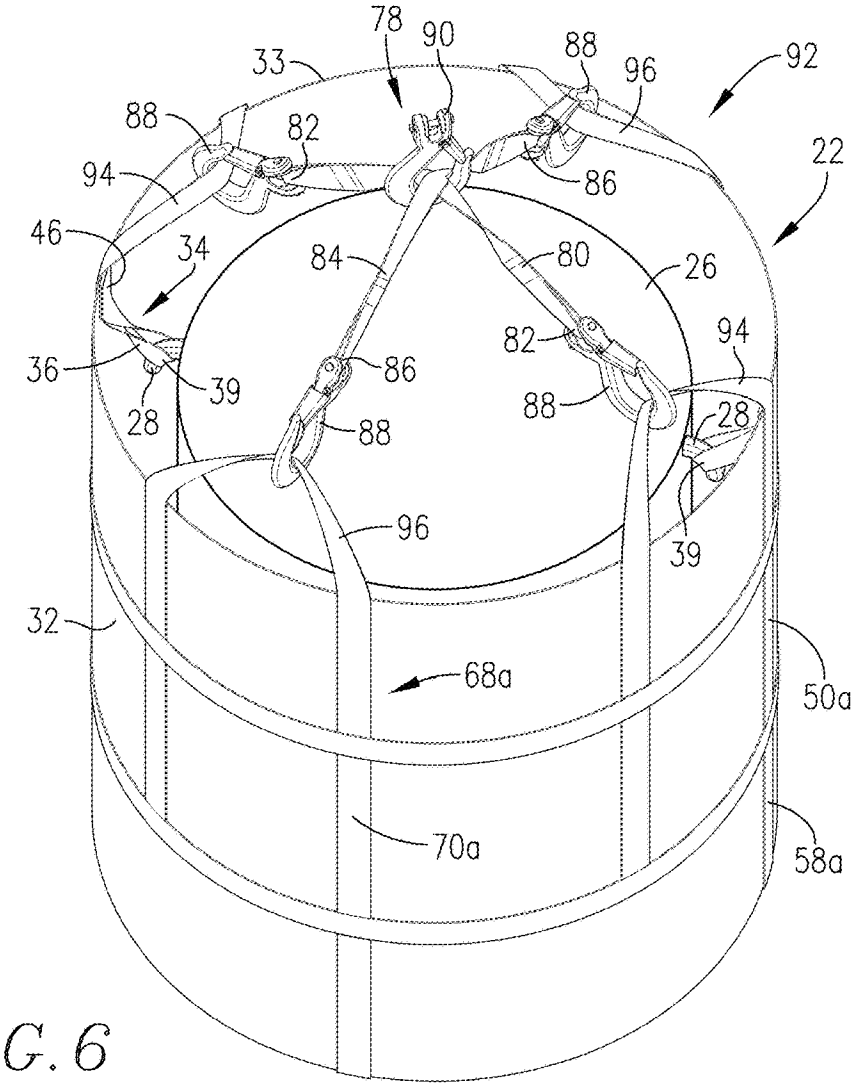
FIG. 6 is a view similar to that of FIG. 5, but depicting a lift assembly operably coupled with the transport bag.
Figure 5:
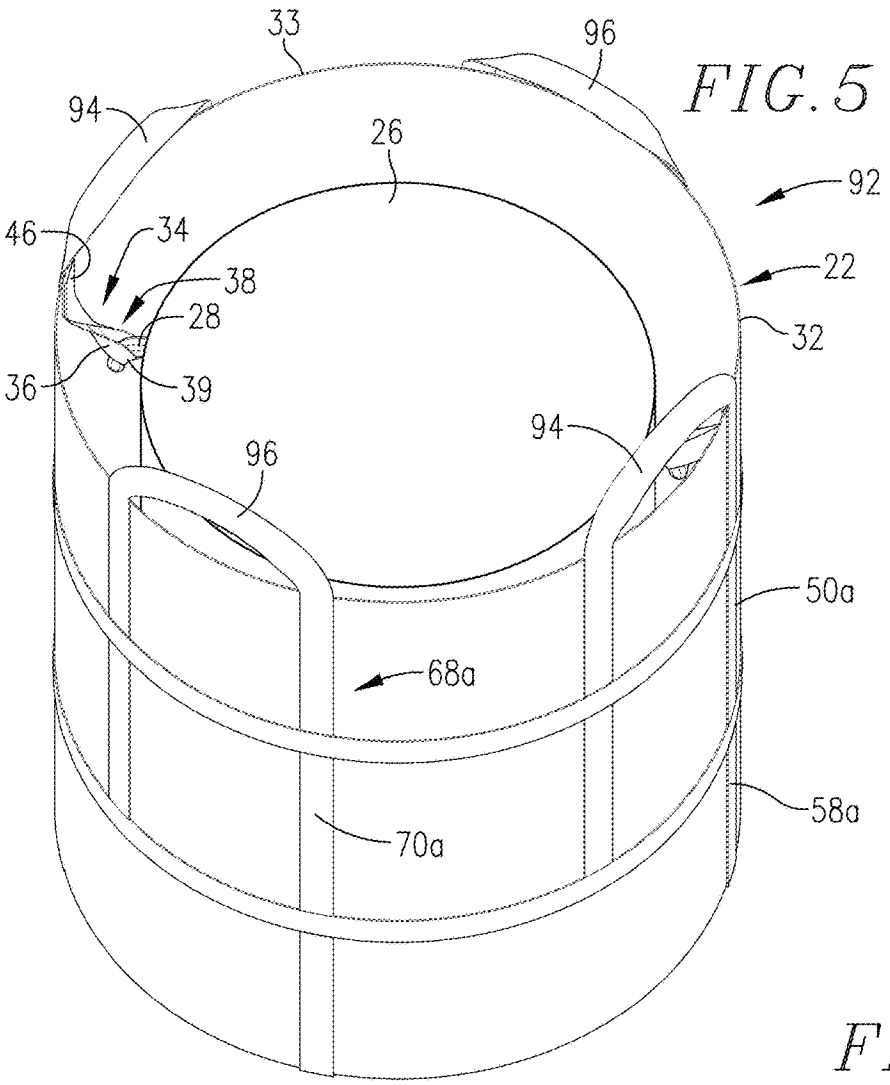
FIG. 5 is a perspective view of another equipment transport bag embodiment in accordance with the invention, illustrated with an electrical transformer therein.

FIGS. 5-6 illustrate another embodiment in accordance with the invention, which is similar in many respects to the embodiment of FIGS. 1-4. Accordingly, identical parts will be given the same reference numerals. The principal difference between the embodiment of FIGS. 5-6 and that of FIGS. 1-4 lies in the fact that, instead of the reverse loops 59 and 72, arcuate sections 94 and 96 are used. Thus, the second U-shaped strap 50*a* has legs 58*a* which extend upwardly along and are connected to the sidewall structure 32, but extend further upwardly and laterally to form the arcuate bight sections 94 and then extend downwardly along the sidewall structure 32 in spaced relationship to the legs 58*a*. Similarly, the upwardly extending legs 70*a* of third U-shaped strap 68*a* extend further above the margin 33 and then laterally to form bight sections 96, with the terminal portions of the strap 68*a* extending downwardly and connecting to sidewall structure 32 in spaced relationship to the legs 70*a*. In all other respects, the embodiment of FIGS. 5-6 is identical to that of FIGS. 1-4.

Figure 8:
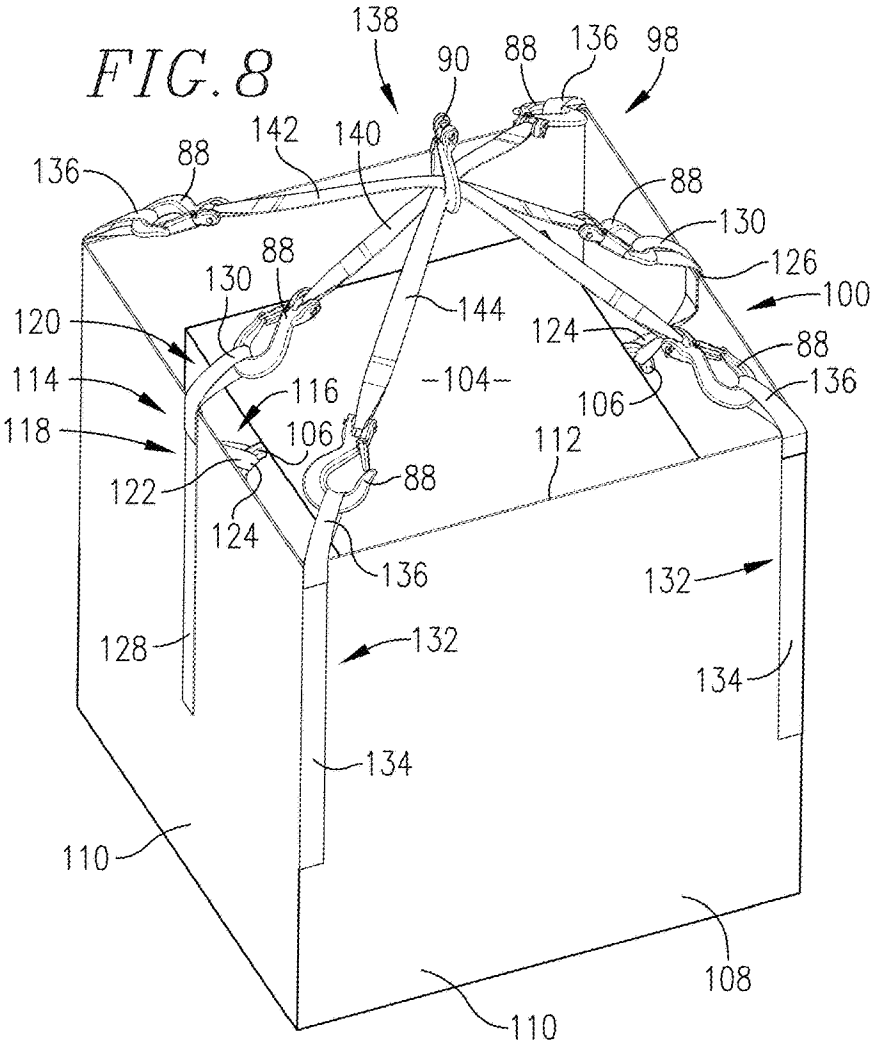
FIG. 8 is a view similar to that of FIG. 7, but depicting a lift assembly operably coupled with the transport bag.
Figure 7:
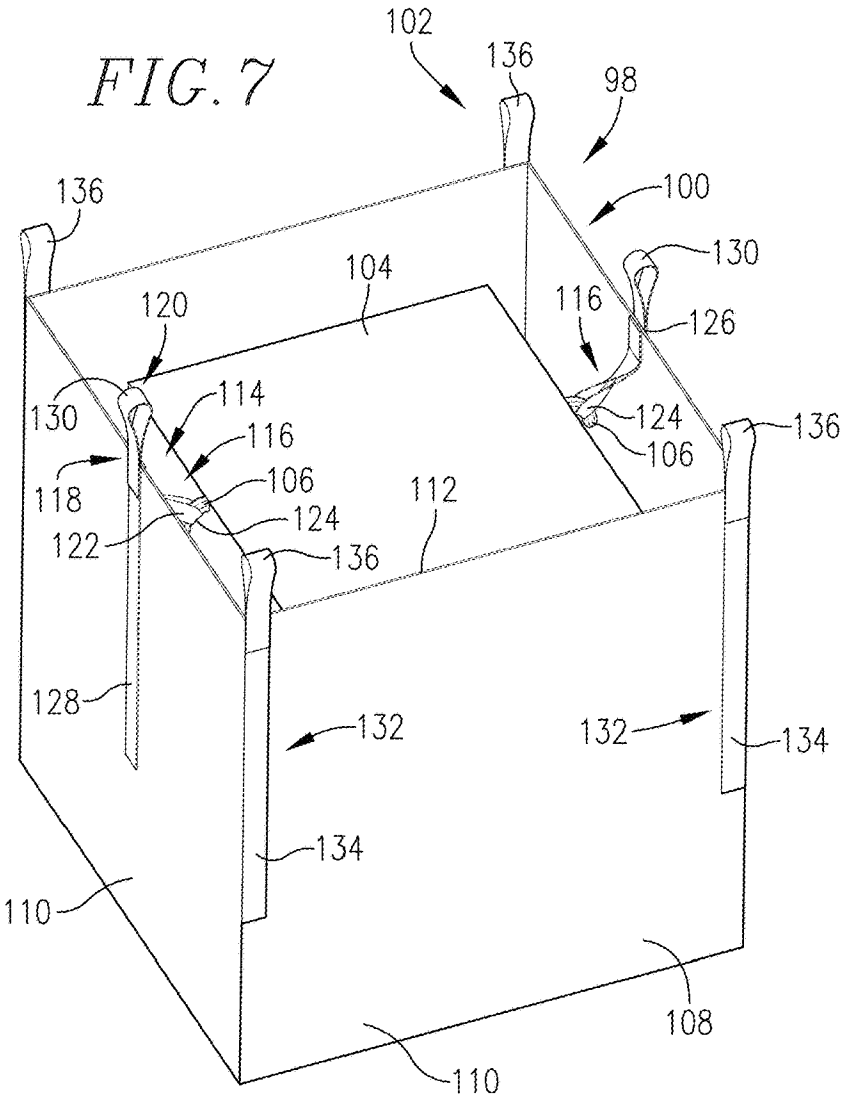
FIG. 7 is a perspective view of another equipment transport bag embodiment in accordance with the invention of quadrate configuration, illustrated with an electrical transformer therein.

FIGS. 7-8 depict a third embodiment in the form of a transport bag assembly 98 including an upright, open-top, substantially quadrate in plan bag 100, together with an equipment-handling assembly 102. Equipment 104 is received within bag 100, and is equipped with side-mounted lifting lugs 106.

The bag 100 includes a bottom wall (not shown) together with sidewall structure 108 in the form of four interconnected sidewall panels 110 cooperatively defining an upper margin 112. The bag 100 is flexible and is formed of appropriate synthetic resin or other suitable material.

The handling assembly 102 includes a pair of opposed, load-bearing strap units 114 secured to sidewall structure 108. Each such strap unit 114 has a first section 116 designed to engage a corresponding lifting lug 106, and a second strap section 118 with an arcuate lifting portion 120. Each of the strap sections 116 are very similar to the sections 36 described above, and include an elongated strap 122 having a loop 124 with the strap ends 126 secured to the inner face of sidewall structure 108 adjacent margin 112. Each strap section 118 is made up of an elongated strap 128 secured to the outer face of sidewall structure 108, with an extension above margin 112 in the form of a reverse loop 130. The strap sections 116 and 118 are secured to each other, and to bag sidewall structure 108 by stitching or any other appropriate means.

The handling assembly 102 also includes a total of four substantially non-load-bearing, bag-orienting strap sections 132 located at the corners of the bag. Each strap section 132 includes an elongated strap 134 secured to the exterior face of sidewall structure 108 and extending above margin 112 with a reverse loop 136. The end of loop section 136 is secured to the upper end of strap 134, and to sidewall structure 108.

A lift assembly 138 is provided for lifting and handling of the bag 100 with equipment 104 therein. The assembly 138 is very similar to that of previously described assembly 78, and includes a lift strap 140 having slip hooks 88 secured to the ends thereof and coupled with the loops 130. Additionally, two other straps 142 and 144 are provided, each having endmost slip hooks 88, and designed to couple with the corner loops 136.

Figure 10:
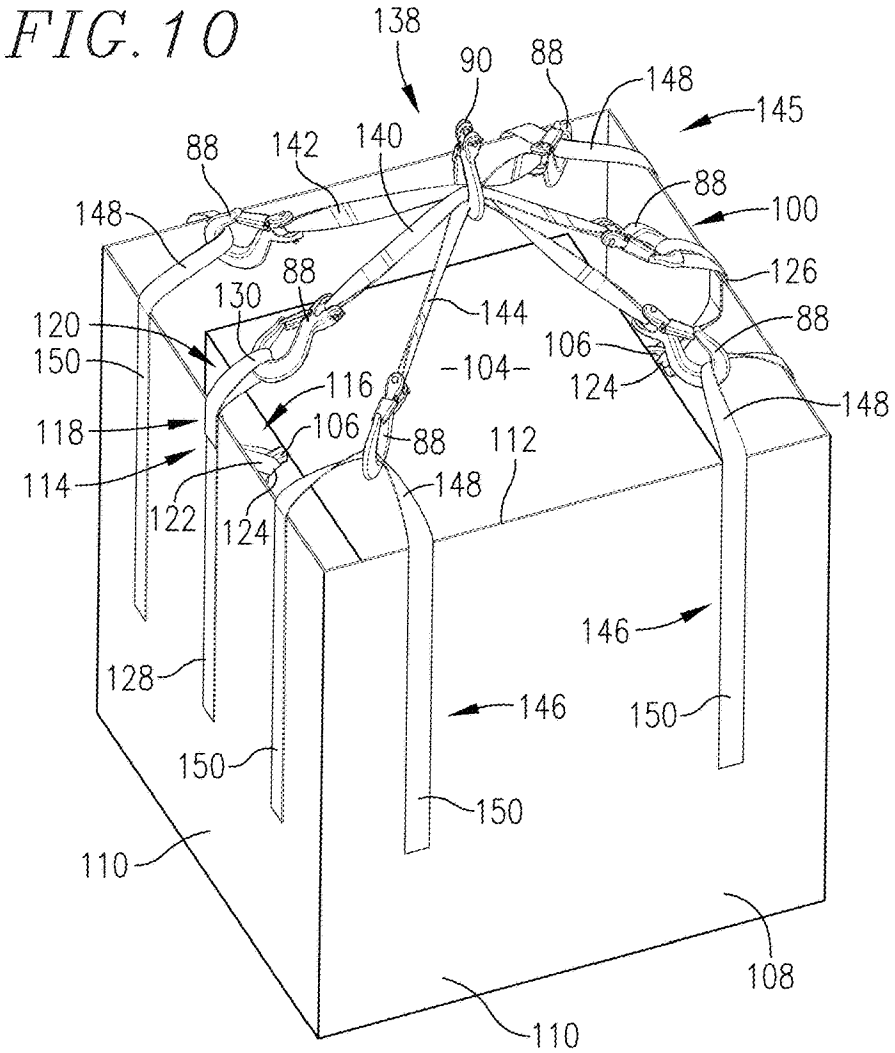
FIG. 10 is a view similar to that of FIG. 9, but depicting a lift assembly operably coupled with the transport bag.
Figure 9:
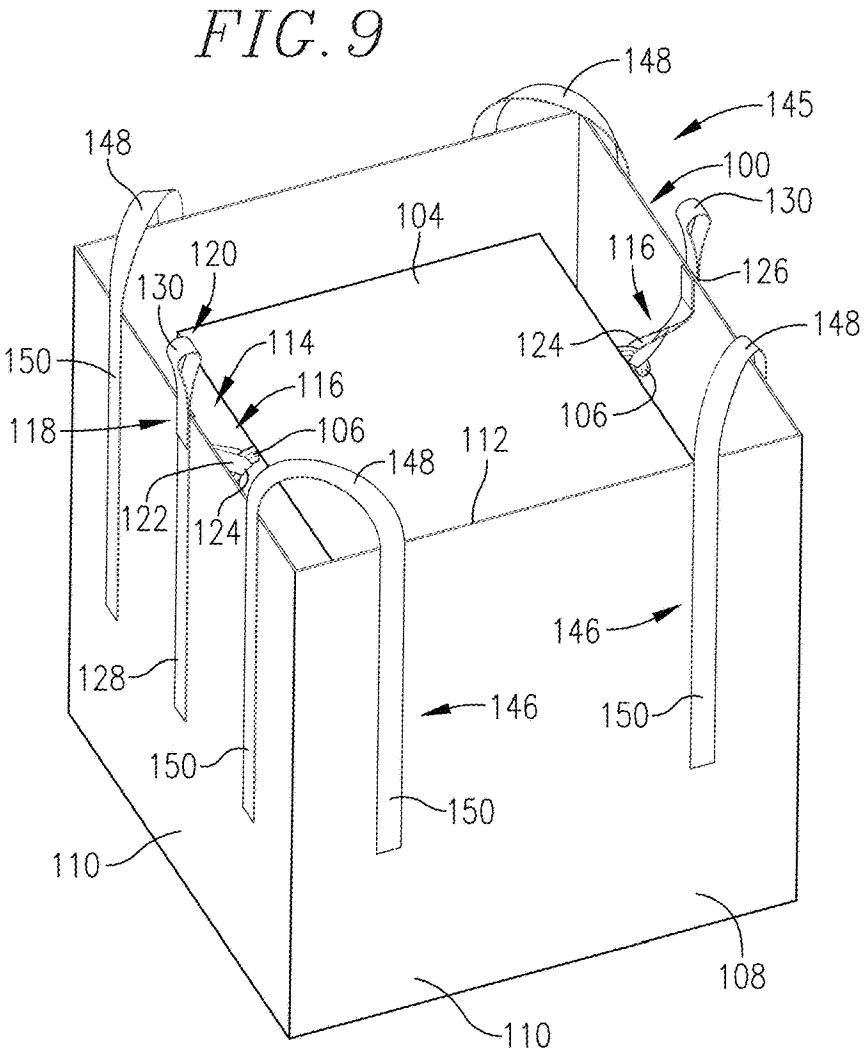
FIG. 9 is a perspective view of another equipment transport bag embodiment in accordance with the invention of quadrate configuration, illustrated with an electrical transformer therein.
Figure 11:
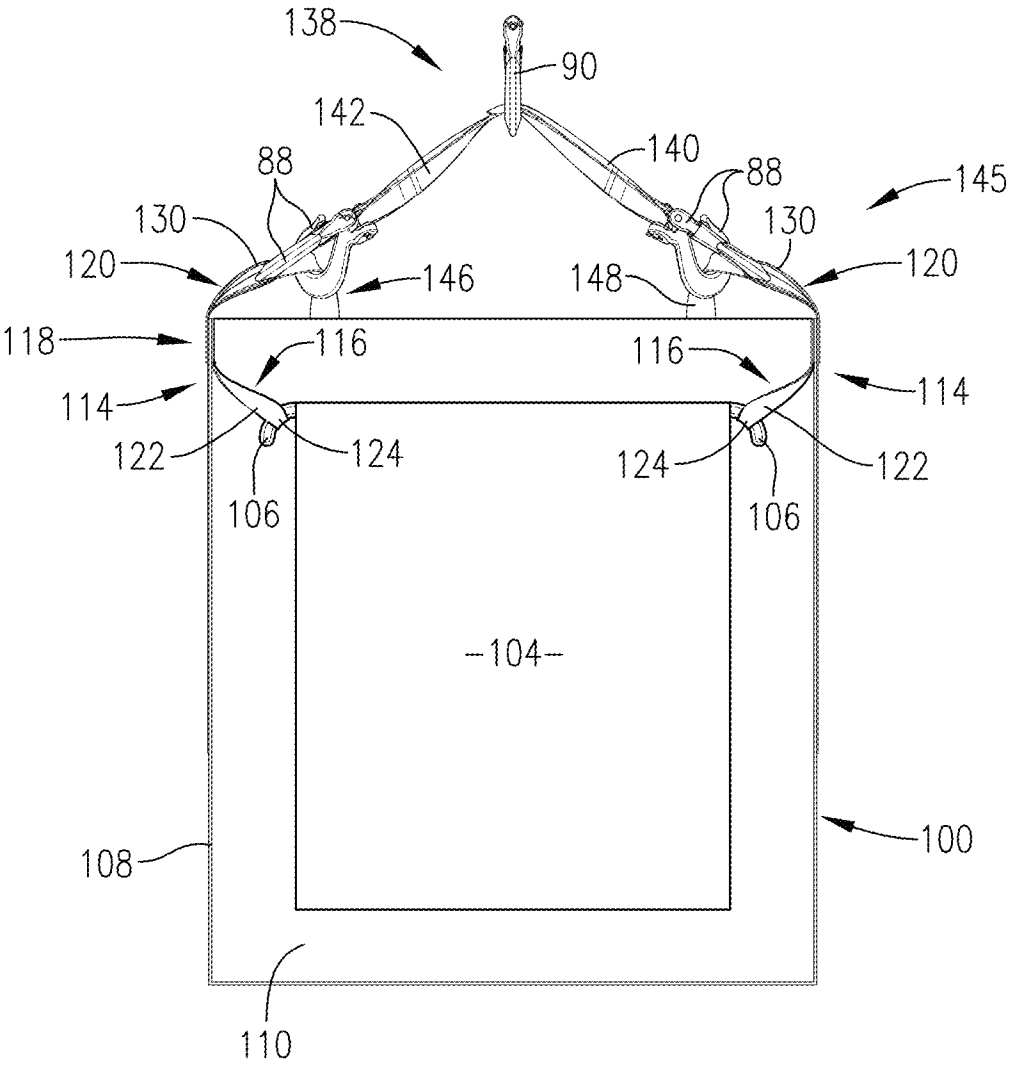
FIG. 11 is a vertical sectional view of the FIG. 7 embodiment, through the bag adjacent the central load-bearing straps, shown with the transformer supported by the load-bearing strap units.

FIGS. 9-11 illustrate a still further embodiment of the invention in the form of a bag assembly 145, which is very similar to that of FIGS. 7-8, and again, like components are identified by the same reference numerals. The only difference between the embodiment of FIGS. 9-11 versus that of FIGS. 7-8 lies in the non-load-bearing corner straps. In FIGS. 9-10, a continuous, generally U-shaped strap 146 is provided adjacent each corner of the bag 100. The straps 146 include an uppermost bight 148 and two downwardly extending legs 150. The latter are secured to the outer faces of the adjacent sidewall panels 110, as illustrated. Likewise, the lift assembly 138 differs only in the connection of the straps 142 and 144 to the bights 148, rather than the loops 136.

Just as in the earlier embodiments, the strap units 114 serve as the primary load-bearing structure, so that the equipment 104 is separate from the bag 100 when elevated.

Each of the embodiments illustrated in FIGS. 1-11 make use of load-bearing strap units having first and second strap sections which are interconnected and secured to the equipment-receiving bag. It should be understood, however, that the invention is not limited to these types of constructions. For example, the load-bearing strap units can be formed from a single strap, which may be connected to the bag or pass through a slit or other opening in the bag sidewall, without any direct connection between the bag and the strap units. In the latter case, the bag is lifted with the single strap units and is retained in place by the latter and the bag-orienting strap sections.

Figure 13:
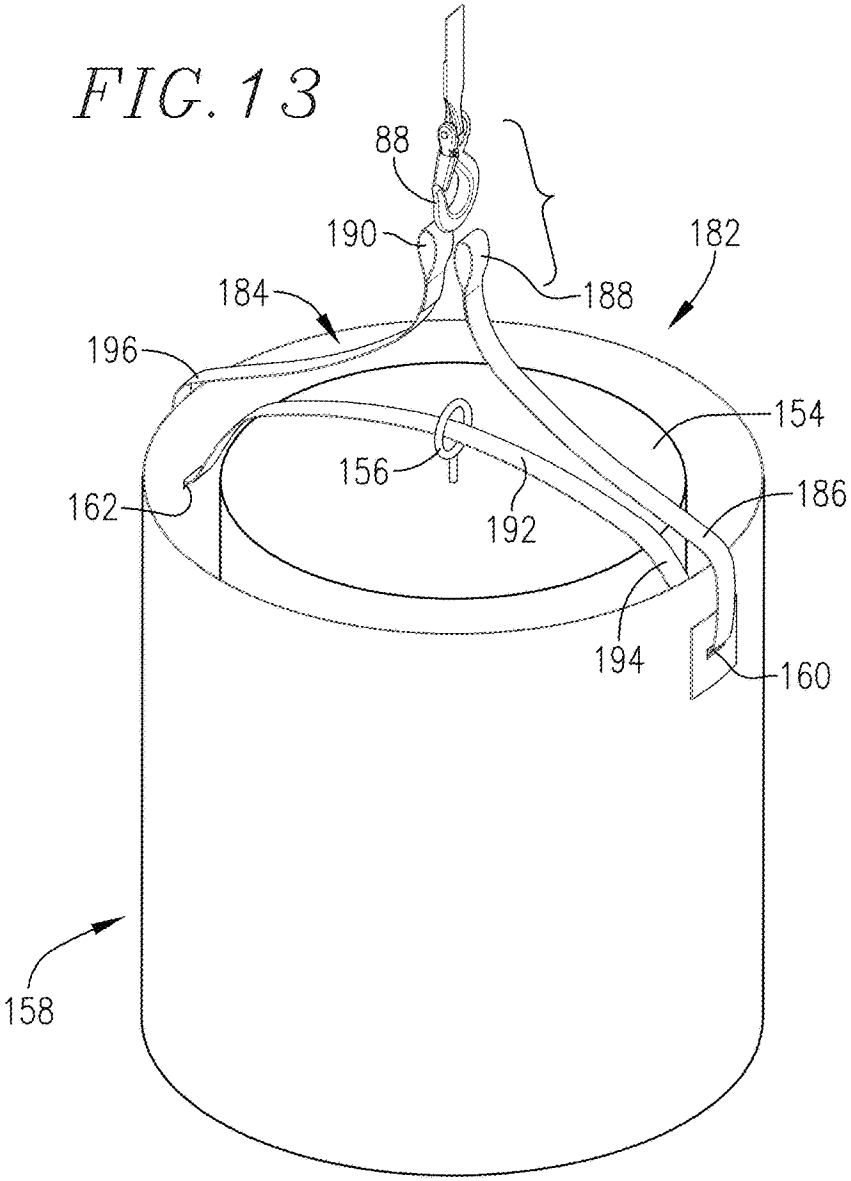
FIG. 13 is another embodiment wherein the lifting appendage is in the form of a central lifting eye, and wherein the equipment handling assembly comprises a single strap having a first portion engaging the lifting eye, second lifting portions respectively passing through openings formed in the bag sidewall, and third lifting portions.
Figure 12:
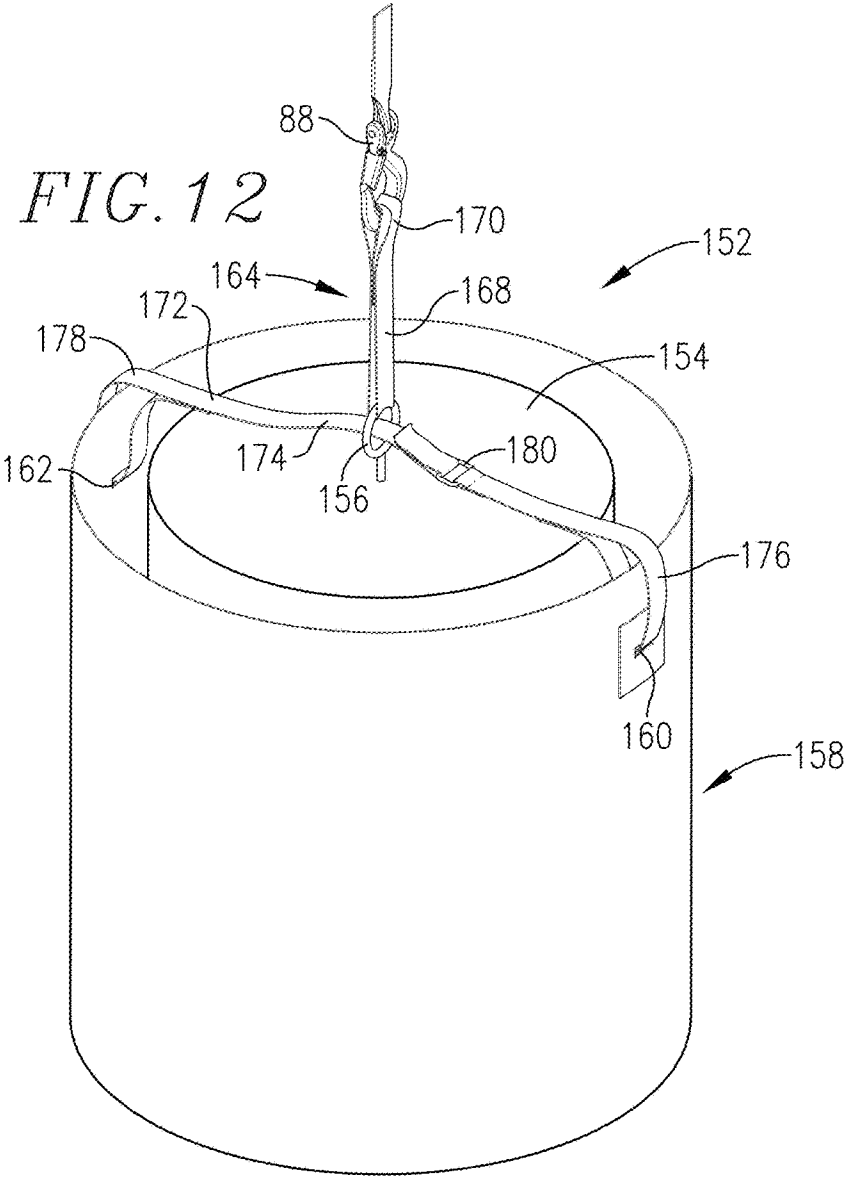
FIG. 12 is a perspective view of another embodiment wherein the lifting appendage is in the form of a central lifting eye, and wherein the equipment handling assembly comprises a pair of strap units.

Embodiments of FIGS. 12 and 13

These embodiments are especially designed for use with equipment having a central, top-mounted lifting eye, in lieu of or in addition to side-mounted lifting lugs.

FIG. 12 illustrates an equipment transport bag assembly 152, which is useful in connection with equipment 154 having an upstanding, central lifting eye 156. As in the case of the earlier embodiments, the assembly 152 has a bag 158, here equipped with a pair of opposed, reinforced opening slits 160, 162 in the sidewall of the bag. The assembly 152 also has an equipment-handling assembly 164 in the form of a first generally U-shaped load-bearing strap unit 166, which has a lower segment 168 engaging the eye 156, and upper loop sections 170 each designed to receive a slip hook 88. The overall assembly 164 also includes a bag-supporting strap 172 having a central section 174 passing through the eye 156, with outboard side loop sections 176, 178 passing through the corresponding opening slits 160, 162. One end of the strap 172 is equipped with a metallic ring 180, whereas the other end has opposed Velcro sections allowing passage through ring 180 and connection to itself.

As will be appreciated from this structure, essentially all of the lifting load is borne by the first strap 166, with the strap 172 supporting only the weight of the bag 158.

FIG. 13 depicts another equipment transport bag assembly 182 to be used with the equipment 154 having lifting eye 156. The assembly 182 is made up of the bag 158 as well as a modified equipment-handling assembly 184. The latter has a single strap unit 186 having terminal loops 188 and 190. As shown, the strap unit has a central section 192 which passes through eye 156, as well as outboard loops sections 194 and 196 respectively passing through the bag opening slits 160, 162. Finally, the strap 186 has third lifting portions in the form of the loops 188, 190. Both of these loops are designed to interfit with a slip hook 88. Again, it will be appreciated that essentially all of the lifting load is carried by the assembly 184, and little if any of such load is transferred to the bag 158.

Figure 14:
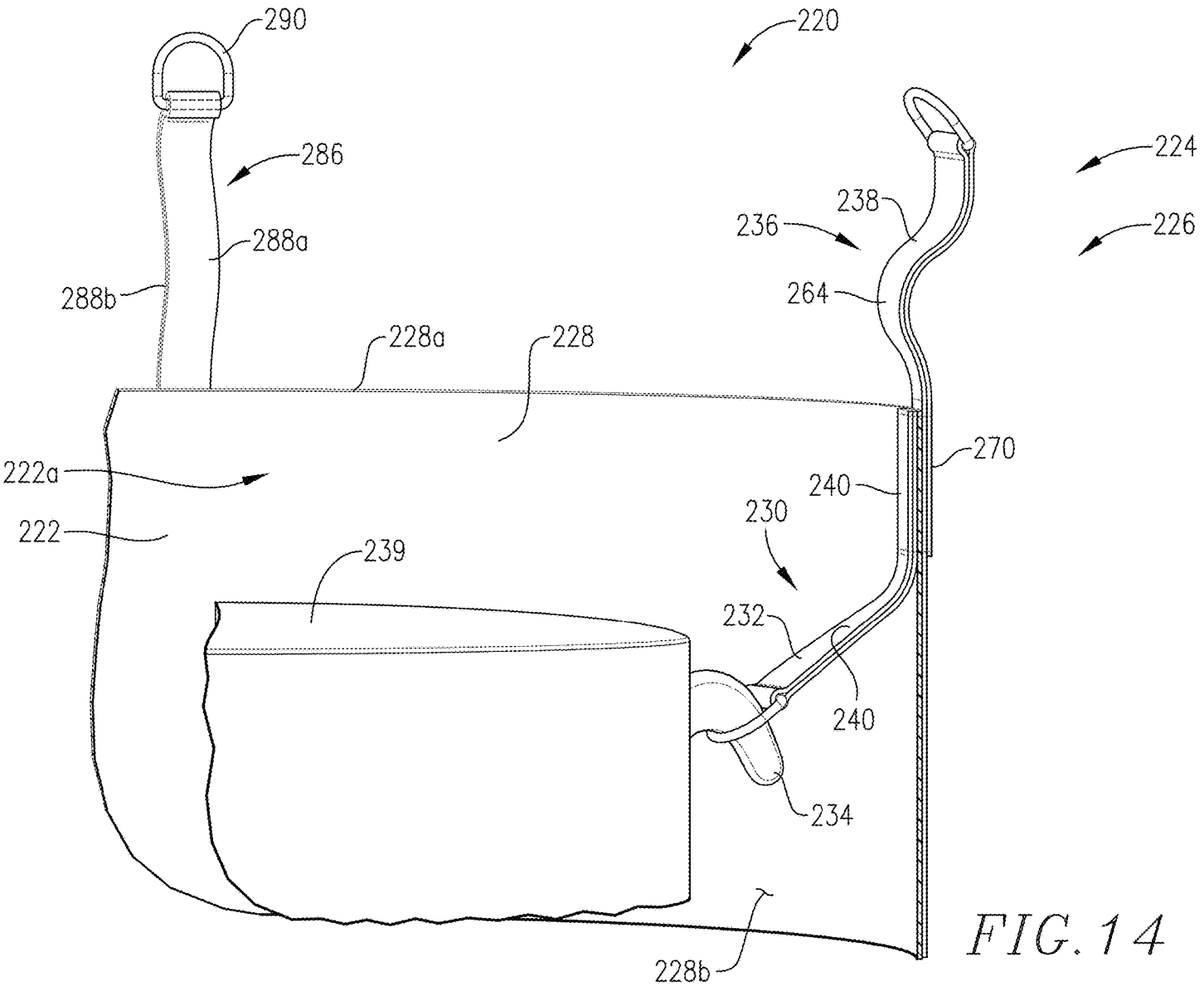
FIG. 14 is a fragmentary vertical sectional view of another equipment transport bag embodiment, illustrated with an electrical transformer therein, wherein the load bearing strap units each include a pair of engagement or connection elements in the form of D-rings.
Figure 14A:
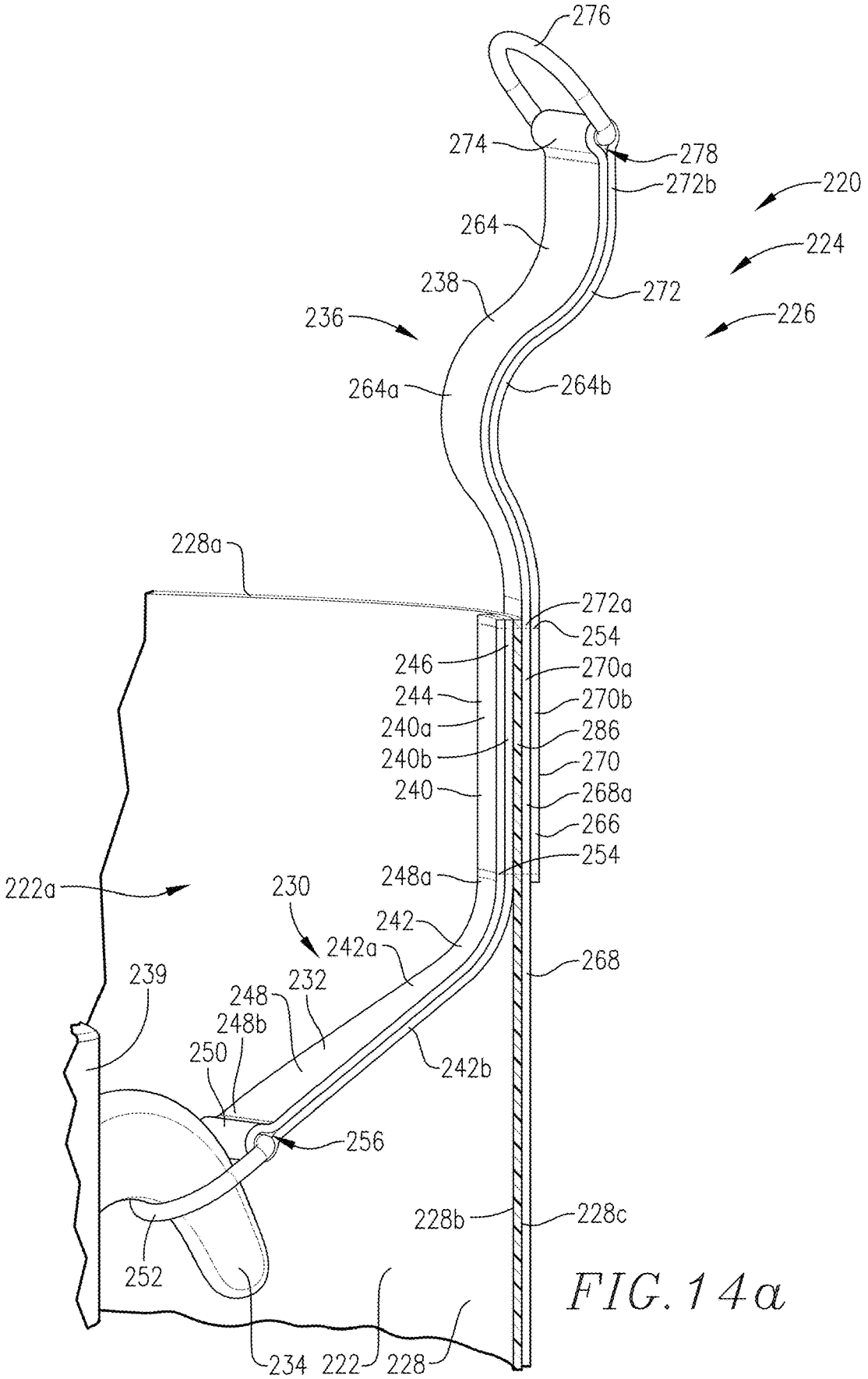
FIG. 14*a* is an enlarged, fragmentary vertical sectional view of a portion of the equipment transport bag of FIG. 14.
Figure 15:
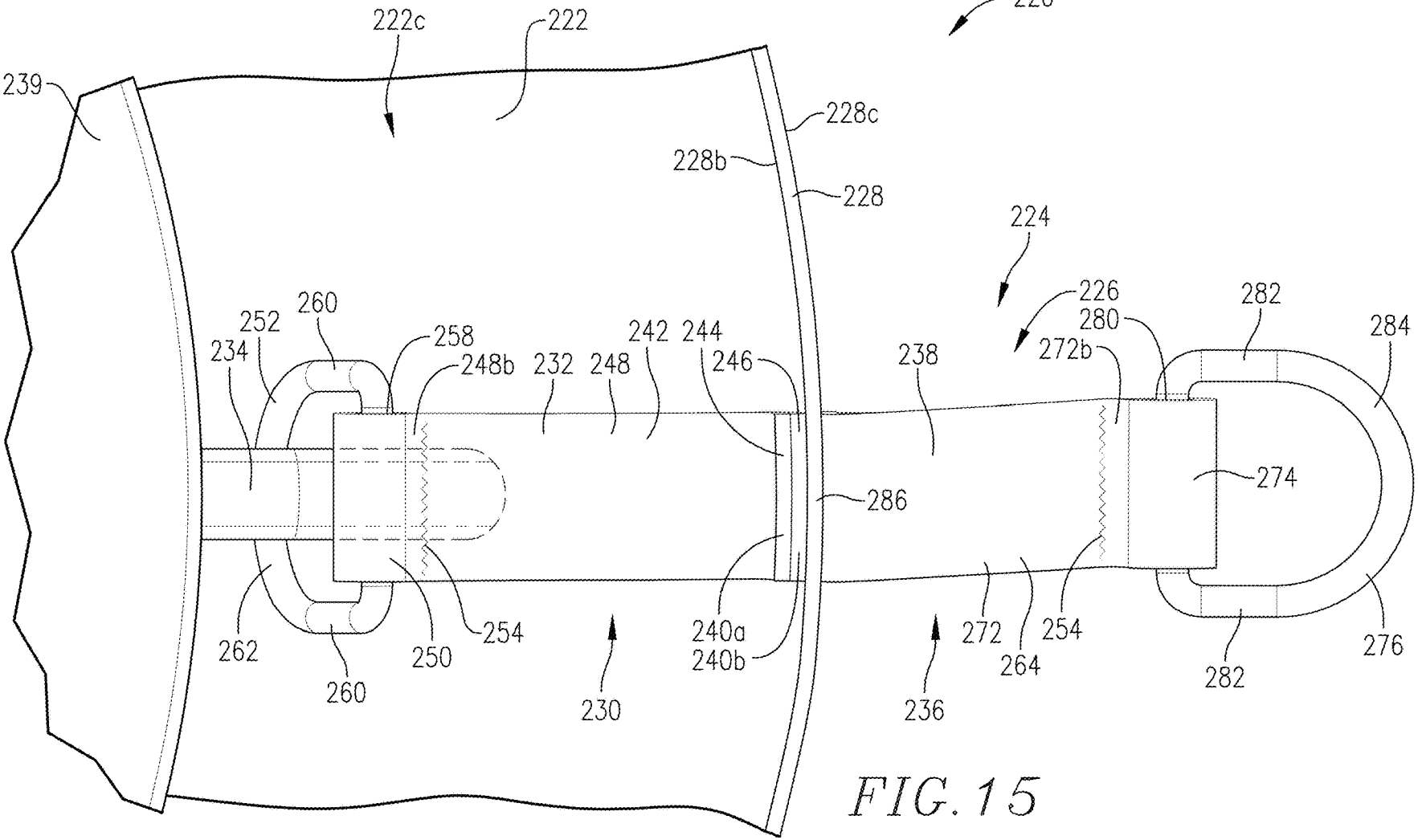
FIG. 15 is an enlarged top sectional view of a portion of the equipment transport bag and transformer of FIG. 14.
Figure 16:
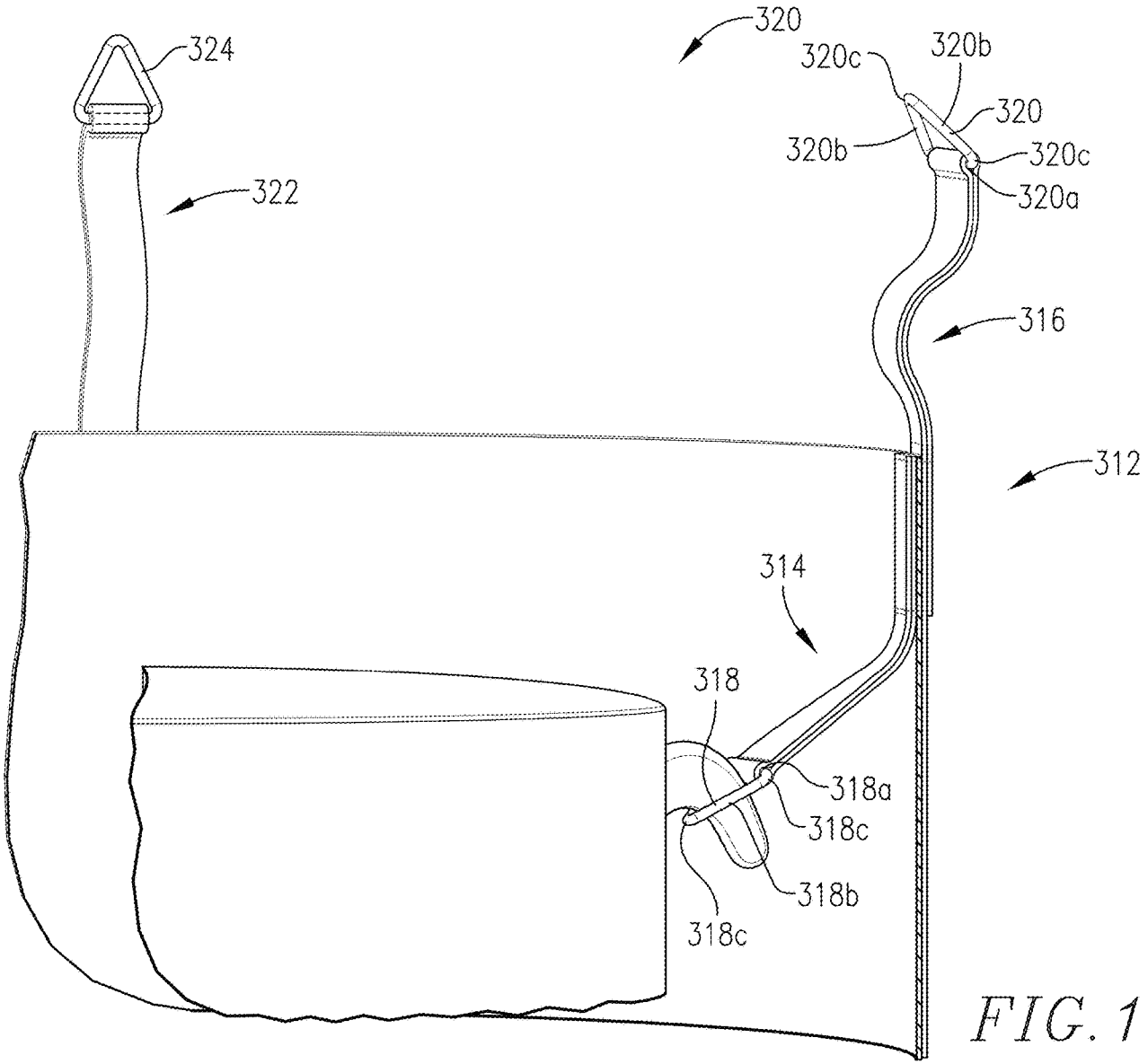
FIG. 16 is a fragmentary vertical sectional view of another equipment transport bag embodiment, illustrated with an electrical transformer therein, wherein the load bearing strap units each include a pair of engagement or connection elements in the form of triangular rings.

Embodiments of FIGS. 14-16

Similar to the embodiments of FIGS. 1-11, these embodiments are particularly designed for use with equipment such as transformers, which are universally provided with a pair of opposed, side-mounted lifting lugs.

Turning now to FIGS. 14 and 15, an equipment transport bag assembly 220 in accordance with a seventh preferred embodiment of the present invention is illustrated. It is initially noted that, with certain exceptions to be discussed in detail below, many of the elements of the equipment transport bag assembly 220 of the seventh embodiment are the same as or very similar to those described in detail above in relation to the bag assemblies 20, 92, 98, 145, 152, and 182 of the first through sixth embodiments. Therefore, for the sake of brevity and clarity, redundant descriptions and numbering will be generally avoided here. Unless otherwise specified, the detailed descriptions of the elements presented above with respect to the first through sixth embodiments should therefore be understood to apply at least generally to the seventh embodiment, as well.

Similarly to the bag assemblies 20, 92, 98, 145, 152, and 182, the equipment transport bag assembly 220 includes an upright, open-top equipment-receiving bag 222 with an associated equipment-handling assembly 224. The equipment-handling assembly 224 includes a plurality of load-bearing strap units 226 (one shown) operably associated with the bag 222 so that the strap units 226 bear the primary loads during lifting and handling of the bag assembly 220. More particularly, the strap units 226 are each secured to a sidewall structure 228 of the bag 222.

The strap units 226 of the bag assembly 220 each include a first strap section 230 with a connection portion 232 designed to engage a corresponding lifting element 234, such as a lifting lug 234. The strap units 226 also each include a second strap section 236 with a lifting portion 238 designed for engagement by a lifting mechanism (not shown).

In a broad sense, the connection portion 232 extends downwardly and into the bag 222 (i.e., into a bag interior 222*a* defined at least in part by the sidewall structure 228) for engagement with a lifting lug 234, whereas the lifting portion 238 is designed to extend upward from the bag 222 when engaged by a lifting mechanism.

Alternatively stated, the connection portion 232 is disposed inboard of and spaced from the sidewall structure 228 (i.e., inside the bag 222, in the bag interior 222*a*) for engagement with a corresponding lifting lug 234 when equipment 239 is in the bag 222.

In greater detail, the first strap section 230 preferably includes a securement portion 240 and the aforementioned connection portion 232. The first strap section 230 is preferably formed primarily or at least substantially from an elongated first strap 242 having end portions 244 and 246 terminating at a location adjacent an upper margin 228*a* of the sidewall structure 228 of the bag 222. (That is, the end portions 244 and 246 preferably do not extend past the upper margin 228*a*, instead terminating adjacent the upper margin 228*a*.)

Alternatively described, the securement portion 240 of the first strap section 230 extends upwardly to a location adjacent the upper margin 228*a*.

More particularly, the end portions 244 and 246 of the first strap 242 preferably overlie one another and are secured along an inner surface 228*b* of the sidewall structure 228 to form or at least substantially form the securement portion 240. That is, the securement portion 240 preferably includes a pair of first-section securement portion segments 240*a* and 240*b*, overlying each other and formed from respective ones of two (2) overlapping layer portions 242*a* and 242*b* of the first strap 242. As will be apparent to those of ordinary skill in the art, the first-section securement portion segments 240*a* and 240*b* also correspond with the end portions 244 and 246 of the first strap 242.

In the illustrated embodiment, the securement portion 240 is secured to the sidewall structure 228 by stitching 254 (shown schematically in simplified form). However, alternative securement means are permissible, including but not limited to adhesives, heat welding, rivets, staples, and so on. The stitching 254 will be discussed in greater detail below.

In contrast to the entirely open-looped nature of the connection portion 38 of the first embodiment, the connection portion 232 of the seventh embodiment preferably includes a non-looped (i.e., flat) main body 248 and a receiving loop 250 at an inboard or distal end 248*b* thereof, in addition to a connection-portion engagement element 252 secured by the receiving loop 250.

In a preferred embodiment, as illustrated, the connection-portion engagement element is a ring 252 that extends through the receiving loop 250.

Similarly to the securement portion 240, the main body 248 of the connection portion 232 preferably is formed by the two (2) overlapping layer portions 242*a* and 242*b* of the first strap 242. Thus, each layer portion 242*a* and 242*b* defines parts of both the securement portion 240 and the connection portion 232.

In a preferred embodiment, the main body 248 of the connection portion 232 extends away from and is devoid of direct connection to or, alternatively stated, is free of any direct connection with the sidewall structure 228. That is, the main body 248 is fixed relative to the sidewall structure 228 via the securement portion 240 but is not itself stitched, adhered, heat-welded, or otherwise directly connected thereto. Stated in yet another way, the main body 248 is only indirectly fixed to the sidewall structure 228. Such freedom from direct connection to the sidewall structure 228 is such that the main body 248 can be readily manipulated as needed to facilitate engagement of the connection portion 232 with the corresponding lifting lug 234.

Stated in yet another way, the main body 248 includes a proximal end 248*a* and the previously mentioned inboard or distal end 248*b*. The proximal end 248*a* is continuous with the securement portion 240, which as noted above is fixed relative to the sidewall structure 228, and is thus also restricted in motion relative to the sidewall structure 228. However, the distal end 248*b*, disposed opposite the proximal end 248*a*, and the remainder of the main body 248, is freely movable except as limited by the connection at the securement portion 240.

The receiving loop 250 is preferably formed at the distal end 248*b* of the main body 248 by a continuous portion of non-overlapping first strap 242 extending between and connecting the layers 242*a* and 242*b* of the main body 248 of the connection portion 232. The receiving loop 250 defines a channel 256 therethrough for receiving a base 258 of the ring 252. The channel 256 is preferably sized such that a tight or slip fit is achieved upon receipt of the base 258, although alternative sizing falls within the scope of some aspects of the present invention.

The ring may also be connected to the first strap in an alternative manner. For instance, the ring might instead be sewn, glued, riveted, stapled, or otherwise fixed directly to the strap (i.e., without the use of a receiving loop).

In a preferred embodiment, the ring 252 is a D-ring including the base 258, a pair of parallel legs 260 extending at least substantially orthogonally from the base 258, and a curved portion 262 forming a distal-most region of the connection portion 232 and, more broadly, of the first strap section 230. Other shapes and configurations of the ring fall within the scope of the present invention, however, including triangular, circular, oval, square, rectangular, and so on.

The second strap section 236 is preferably identical in structure to the first strap section 230 but oriented oppositely or at least substantially oppositely. Unless otherwise specified, the detailed descriptions of the elements presented above with respect to the first strap section 230 should therefore be understood to apply at least generally to the second strap section 236, as well.

More particularly, the second strap section 236 is preferably formed primarily or at least substantially from an elongated second strap 264 having a first end portion 266 (shown) and a second end portion (not shown). The first end portion 266 preferably terminates at a location below and spaced from the upper margin 228*a* of the sidewall structure 228. The second end portion (not shown) is similarly disposed at an opposed position on the bag assembly 220 and is associated with another second strap section (not shown). This is in keeping with a preferred U-shaped, bight- and leg-based form of the second strap section 236 and second strap 264, similar to that described in detail above with respect to the second strap 42 of the first preferred embodiment. It is noted that only a single leg 268 of this U-shaped form is visible in FIG. 14.

The second strap 264 is preferably discrete from (i.e., distinct from) the first strap 242. However, it is permissible according to some embodiments of the present invention for the first and second strap sections to be cooperatively or unitarily formed by a single strap or by more than two (2) straps.

The second strap section 236 preferably includes a securement portion 270 and the previously introduced lifting portion 238 (analogous to the securement portion 240 and the connection portion 232, respectively, of the first strap section 230).

The securement portion 270 preferably extends downwardly from the upper margin 228*a* to a location below the upper margin 228*a* (by what may be referred to as a securement portion distance).

More particularly, the end 266 of the second strap 264 and an upper portion 268*a* of the associated leg 268 preferably overlie one another and are secured along an outer surface 228*c* of the sidewall structure 228 to form or at least substantially form the securement portion 270.

That is, the second-section securement portion 270 preferably includes a pair of second-section securement portion segments 270*a* and 270*b*, overlying each other and formed from respective ones of two (2) overlapping layer portions 264*a* and 264*b* of the second strap 264. As will be apparent to those of ordinary skill in the art, the second-section securement portion segments 270*a* and 270*b* also correspond with the upper portion 268*a* of the leg 268 and the end portion 266 of the second strap 264.

It is particularly noted that the upper portion 268*a* of the leg 268 may additionally or alternatively understood to define an "end" or "transition point" of sorts of the second strap 264, albeit one that does not terminate discretely but instead extends continuously with the remainder of the leg 268. That is, because only the upper portion 268*a* of the leg 268 is part of the second strap section 236 of the strap unit 226, a theoretical demarcation or break may be understood to exist between the upper portion 268*a* and the remainder of the leg 268.

It is also particularly noted that embodiments are permissible in which the second strap terminates completely rather than forming a leg. That is, the second strap could include two terminal end portions that form the securement portion, similar to the end portions 244 and 246 and securement portion 240 of the first strap 242.

In the illustrated embodiment, the securement portion 270 is secured to the sidewall structure 228 by stitching 254 (shown schematically in simplified form), as also noted above with regard to the securement portion 240. However, alternative securement means are permissible, including but not limited to adhesives, heat welding, rivets, staples, and so on.

The lifting portion 238 preferably includes a non-looped or flat main body 272, a receiving loop 274 at an outboard or distal end 272*b* thereof (opposite a proximal end 272*a*), and a connection element or ring 276 secured by the receiving loop 274.

Similarly to the securement portion 270, the main body 272 preferably includes two (2) overlapping layer portions 264*a* and 264*b* of the second strap 264.

In a preferred embodiment, the main body 272 extends away from and is devoid of connection to or, alternatively stated, is free of any connection with the sidewall structure 228, as described above with regard to the main body 248.

The receiving loop 274 is preferably formed by a continuous portion of non-overlapping second strap 264 extending between and connecting the layers 264*a* and 264*a* of the main body 272. The receiving loop 274 defines a channel 278 therethrough for receiving a base 280 of the ring 276. As noted above, however, alternative means of securing the ring relative to the strap fall within the scope of some aspects of the present invention, however.

In a preferred embodiment, the ring 276 is a D-ring including the base 280, a pair of legs 282, and a curved portion 284 forming a distal-most region of the lifting portion 238 and, more broadly, of the second strap section 236.

Each of the rings 252 and 276 preferably comprises metal, although other materials fall within the scope of the present invention.

Although the rings 252 and 276 are identical in the present embodiment, it is permissible according to some aspects of the present invention for the rings to be differently configured. That is, one ring might be a D-ring, as shown, while the other might be circular or triangular.

The equipment transport bag assembly 220 also preferably includes a pair of opposed, non-load-bearing, bag-orienting strap sections 286 (only one shown) corresponding to the strap sections 60 and 62 of the first preferred embodiment but modified similarly to the second strap sections 236 of the present embodiment (e.g., to include overlying strap layers 288*a,b* and a terminal ring 290).

It is also permissible for both rings to be of a different shape than the D-ring form shown in FIGS. 14 and 15. For instance, FIG. 16 illustrates an equipment transport bag assembly 320 in accordance with an eighth preferred embodiment of the present invention, wherein a strap unit 312 includes first and second strap sections 314 and 316 that are identical to the strap sections 230 and 236 of the seventh preferred embodiment except in the provision of triangular (as opposed to D-shaped) rings 318 and 320 at the distal ends thereof. More particularly, in the illustrated embodiment, each ring 318 and 320 includes a base 318*a* or 320*a* and a pair of sides 318*b* or 320*b* extending from the respective base 318*a* or 320*a* and cooperatively forming respective apices 318*c* and 320*c*.

One of two (2) non-load-bearing, bag-orienting strap sections 322 is also illustrated, with a triangular ring 324 at a distal end thereof.

Although the illustrated rings 318, 320, and 324 are in the form of acute isosceles triangles, alternative types of triangles (e.g., right, equilateral, obtuse, etc.) are permissible according to some aspects of the present invention.

Turning again to the seventh embodiment, as shown in FIGS. 14 and 15, it is particularly noted that the first strap ends 244 and 246 and the second strap end and leg upper portion 266 and 268*a*, respectively, are preferably positioned such that the securement portions 240 and 270 are at least in part aligned with each other. More preferably, the securement portions 240 and 270 are at least substantially aligned with each other; and most preferably, the securement portions 240 and 270 are fully aligned with each other. That is, the securement portions 240 and 270 are most preferably identically sized and shaped, as well as being positioned in vertical and circumferential alignment with each other.

Stated another way, the securement portions 240 and 270 preferably extend parallel to one another.

It is also noted that, in keeping with the generally opposed extension directions of the first-section connection portion 232 and the second-section lifting portion 238, the first-section and second-section securement portions 240 and 270 are preferably secured in at least substantially opposite orientations.

As will be apparent from the above, the securement portion 240 is preferably disposed radially inward from the securement portion 270. In greater detail still, the sidewall structure 228 is preferably disposed between (i.e., sandwiched between) the securement portions 240 and 270.

Alternatively described, the securement portions 240 and 270 (and, more particularly, the securement portion segments 240*a*, 240*b*, 270*a*, and 270*b*) are preferably disposed in overlapping alignment with one another and further are disposed in overlapping or overlying engagement with a shared overlapped portion 286 of the sidewall structure 228. Even more particularly, the securement portion segments 240*b* and 270*a* are preferably disposed in direct overlying engagement with the portion 286 of the sidewall structure 228.

As noted previously, stitching 254 (or some other connection means, as discussed above) is provided to fix, connect, or secure the securement portions 240 and 270 to the bag 222. Preferably, the stitching 254 extends continuously through each of the layers 242*a*, 242*b*, 286, 264*a*, and 264*b* (or, alternatively described, through segments 240*a*, 240*b*, 286, 270*a*, and 270*b*), such that the securement portions 240 and 270 are also secured to each other.

It is noted that the above configuration ensures that the securement portion segments 240*b* and 270 are not only disposed in directly overlying engagement with the sidewall structure 228, as noted above, but also are directly secured or connected thereto.

Furthermore, the stitching 254 is preferably configured (e.g., as a result of material, stitch pattern, technique, etc.) to resist peel forces and facilitate transfer of shear forces between the securement portion 240 and the securement portion 270. Thus, in a broader sense, the stitching 254 and the bag assembly 220 in general are configured to facilitate efficient transfer of forces from the connection portion 232 of the first strap section 230 (as generated by the weight of the equipment 239 transmitted via the lug 234) to the lifting portion 238 of the second strap section 236, which in turn transfers forces to the lifting mechanism (not shown). This transfer of forces is an essential feature of the present invention, with forces being transmitted in a controlled mode (i.e., in shear) through the strap unit 226 and with forces bypassing or at least substantially bypassing the bag 222 itself (including the sidewall structure 228).

That is, the bag 222 is preferably not configured to withstand substantial loads associated with support of the equipment and, by merit of the strap unit 226 design, is not subjected to such loads. Rather, the bag 222 acts as a contaminant or fluid containment unit and/or shield, with the strap units 226 and the associated lift assembly (not shown) bearing a substantial part or substantially all of the lifting load. In such a preferred scenario, the bag 222 itself bears simply its own weight, that of any fluid or other contaminants collected therein, and only a minor portion or none of the lifting load.

Features of one or more embodiments described above may be used in various combinations with each other and/or may be used independently of one another. For instance, although a single disclosed embodiment may include a preferred combination of features, it is within the scope of certain aspects of the present invention for the embodiment to include only one (1) or less than all of the disclosed features, unless the specification expressly states otherwise or as might be understood by one of ordinary skill in the art. Therefore, embodiments of the present invention are not necessarily limited to the combination(s) of features described above.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

Although the above description presents features of preferred embodiments of the present invention, other preferred embodiments may also be created in keeping with the principles of the invention. Furthermore, as noted previously, these other preferred embodiments may in some instances be realized through a combination of features compatible for use together despite having been presented independently as part of separate embodiments in the above description.

The inventors hereby state their intent to rely on the Doctrine of Equivalents to determine and access the reasonably fair scope of the present invention as pertains to any apparatus not materially departing from but outside the literal scope of the invention set forth in the following claims.

We claim:

1. An apparatus for use with an equipment lift assembly, said apparatus comprising:

equipment including a lifting element; and an equipment transport bag assembly handling the equipment, said bag assembly including an upright bag defining an interior receiving the equipment therein, said bag assembly further including an equipment-handling assembly, said equipment handling assembly including a strap unit, said strap unit including a first section and a second section, said first section including a first-section securement portion and a first-section connection portion extending from the first-section securement portion into the bag interior, said first-section connection portion engaging the lifting element of the equipment located within the bag interior, said second section including a second-section securement portion and a second-section lifting portion extending away from the bag interior, said first section being operably connected to the second section such that the first-section securement portion is secured in an orientation generally opposite that of the second-section securement portion, and the first-section connection portion extends generally away from the second-section lifting portion, said bag being operably connected to at least one of said first and second sections such that the equipment-handling assembly supports the equipment within the bag interior and functions as the primary load-bearing component of the equipment transport bag assembly during lifting and handling of the equipment using the equipment transport bag assembly.

2. The apparatus of claim 1, said connection portion including a connection-portion main body and a connection-portion engagement element, said connection-portion main body having an inboard end, said connection-portion element being disposed at the inboard end and engaging the lifting element of the equipment located within the bag interior.

3. The apparatus of claim 2, said connection-portion element including a connection-portion ring.

4. The apparatus of claim 3, said connection-portion ring being D-shaped or triangular.

5. The apparatus of claim 3, said connection-portion element further including a ring-receiving loop disposed at the inboard end, said connection-portion ring extending through said ring-receiving loop.

6. The apparatus of claim 2, said lifting portion including a lifting-portion main body and a lifting-portion engagement element, said lifting-portion main body having an outboard end, said lifting-portion element being disposed at the outboard end.

7. The apparatus of claim 6, said lifting-portion element including a lifting-portion ring.

8. The apparatus of claim 1, said first section including a first strap, said connection portion including a main body, said connection-portion main body and said first-section securement portion being cooperatively at least substantially defined by said first strap.

9. The apparatus of claim 8, said connection-portion main body comprising overlying layers of said first strap.

10. The apparatus of claim 8, said second section including a second strap discrete from the first strap, said lifting portion including a lifting-portion main body, said lifting-portion main body and said second-section securement portion being cooperatively at least substantially defined by said second strap.

11. The apparatus of claim 10, said connection-portion main body comprising overlying layers of said first strap, said lifting-portion main body comprising overlying layers of said second strap.

12. The apparatus of claim 1, said first-section securement portion at least in part extending upward from the first-section main body, said second-section securement portion at least in part extending downward from the second-section main body, in a direction generally opposite the first-section securement portion.

13. The apparatus of claim 12, said first-section securement portion including a pair of first-section securement portion segments, said second-section securement portion including a pair of second-section securement portion segments.

14. The apparatus of claim 13, said first-section securement portion segments overlying each other, said second-section securement portion segments overlying each other.

15. The apparatus of claim 14, said first-section securement portion segments and said second-section securement portion segments all being disposed in overlapping alignment with each another.

16. The apparatus of claim 13, said first-section securement portion segments being secured to said second-section securement portion segments by stitching.

17. The apparatus of claim 13, said bag including a bottom wall and sidewall structure extending upwardly from the bottom wall, said sidewall structure being sandwiched between at least a pair of said first-section securement portion segments and said second-section securement portion segments.

18. The apparatus of claim 17, said sidewall structure being directly connected to at least one of said first-section securement portion segments and at least one of said second-section securement portion segments.

19. The apparatus of claim 12, said first-section securement portion and said second-section securement portion extending parallel to one another.

20. The apparatus of claim 12, said bag including a bottom wall and sidewall structure extending upwardly from the bottom wall to present an upper margin, said first-section securement portion extending upward to a location adjacent the upper margin, said second-section securement portion extending downward to a location below the upper margin.

21. The apparatus of claim 1, said bag including a bottom wall and sidewall structure extending upwardly from the bottom wall, said connection portion being inboard of and spaced from the sidewall structure.

* * * * *